US007482948B1

(12) United States Patent
Northway et al.

(10) Patent No.: US 7,482,948 B1
(45) Date of Patent: Jan. 27, 2009

(54) ROADWAY SYSTEMS AND METHODS FOR CONDITIONALLY TRANSMITTING A RADIO SIGNAL TO VEHICLES, DEPENDING ON WHETHER A CERTAIN PERSON IS IN THE AREA

(75) Inventors: Tedrick N. Northway, Wood River, IL (US); Randy S. Johnson, O Fallon, MO (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 12/111,762

(22) Filed: Apr. 29, 2008

(51) Int. Cl.
*G08G 1/07* (2006.01)

(52) U.S. Cl. ..... 340/925; 340/436; 340/901; 340/905; 340/916; 340/918; 116/63 R; 701/117

(58) Field of Classification Search ..... 340/435–436, 340/901, 903–905, 916–919, 925; 116/63 R; 701/117
See application file for complete search history.

(56) References Cited

U.S. PATENT DOCUMENTS

| | | | | |
|---|---|---|---|---|
| 4,025,922 | A | 5/1977 | Trawick | |
| 5,642,093 | A * | 6/1997 | Kinoshita et al. | 340/439 |
| 5,764,139 | A | 6/1998 | Nojima et al. | |
| 6,049,295 | A * | 4/2000 | Sato | 340/928 |
| 6,223,125 | B1 | 4/2001 | Hall | |
| 6,418,371 | B1 | 7/2002 | Arnold | |
| 6,563,426 | B2 * | 5/2003 | Herzberg | 340/573.1 |
| 6,707,391 | B1 * | 3/2004 | Monroe | 340/901 |
| 6,822,581 | B2 * | 11/2004 | Chaffe | 340/907 |
| 6,947,064 | B1 | 9/2005 | Hahn et al. | |
| 7,042,345 | B2 * | 5/2006 | Ellis | 340/436 |
| 7,167,105 | B2 * | 1/2007 | Butzer et al. | 340/907 |
| 7,317,405 | B2 * | 1/2008 | Green et al. | 340/907 |
| 2004/0225434 | A1 * | 11/2004 | Gotfried | 701/200 |
| 2006/0109095 | A1 | 5/2006 | Takata et al. | |
| 2006/0197682 | A1 * | 9/2006 | Crocker et al. | 340/902 |
| 2008/0018494 | A1 * | 1/2008 | Waite et al. | 340/907 |

FOREIGN PATENT DOCUMENTS

| | | |
|---|---|---|
| EP | 1775692 A2 | 4/2007 |

* cited by examiner

*Primary Examiner*—George Bugg
*Assistant Examiner*—Son M Tang
(74) *Attorney, Agent, or Firm*—Jackson Patent Law Office

(57) ABSTRACT

Disclosed are alert systems and methods for a roadway. According to one exemplary method, there is a step of receiving an identification signal from a device carried by a human having a medical condition. Subsequently, circuitry acts to conditionally cause a changeable road sign to display the medical condition, and conditionally transmit a radio warning signal to a vehicle, the radio warning signal indicating the medical condition.

1 Claim, 10 Drawing Sheets

ROADWAY SYSTEMS AND METHODS FOR CONDITIONALLY TRANSMITTING A RADIO SIGNAL TO VEHICLES, DEPENDING ON WHETHER A CERTAIN PERSON IS IN THE AREA

BACKGROUND OF THE INVENTION

1. Field of the Invention

This invention relates generally to systems and methods for roadways and, more particularly, to systems and methods of alerting motorists when automobiles must be operated with special care.

2. Description of Related Art

When an automobile approaches an area where the motorist needs be aware of people with special needs, warning signs may be missed.

SUMMARY OF THE INVENTION

To address the problem above, there is a method for operating with a vehicle, the method comprising the steps, performed outside of the vehicle, of receiving a signal from a device carried by a person outside of the vehicle, without actuation of the device by the person; demodulating the signal into a digital signal; comparing the digital signal to a data structure associated with a road sign in the vicinity of the vehicle; and conditionally transmitting a radio signal to the vehicle, depending on a result of the comparing step.

BRIEF DESCRIPTION OF THE DRAWINGS

References are made to the following text taken in connection with the accompanying drawings, in which.

The accompanying drawings which are incorporated in and which constitute a part of this specification, illustrate embodiments of the invention and, together with the description, explain the principles of the invention, and additional advantages thereof. Certain drawings are not necessarily to scale, and certain features may be shown larger than relative actual size to facilitate a more clear description of those features. Throughout the drawings, corresponding elements are labeled with corresponding reference numbers.

DETAILED DESCRIPTION OF EXEMPLARY EMBODIMENTS

Figure 1:
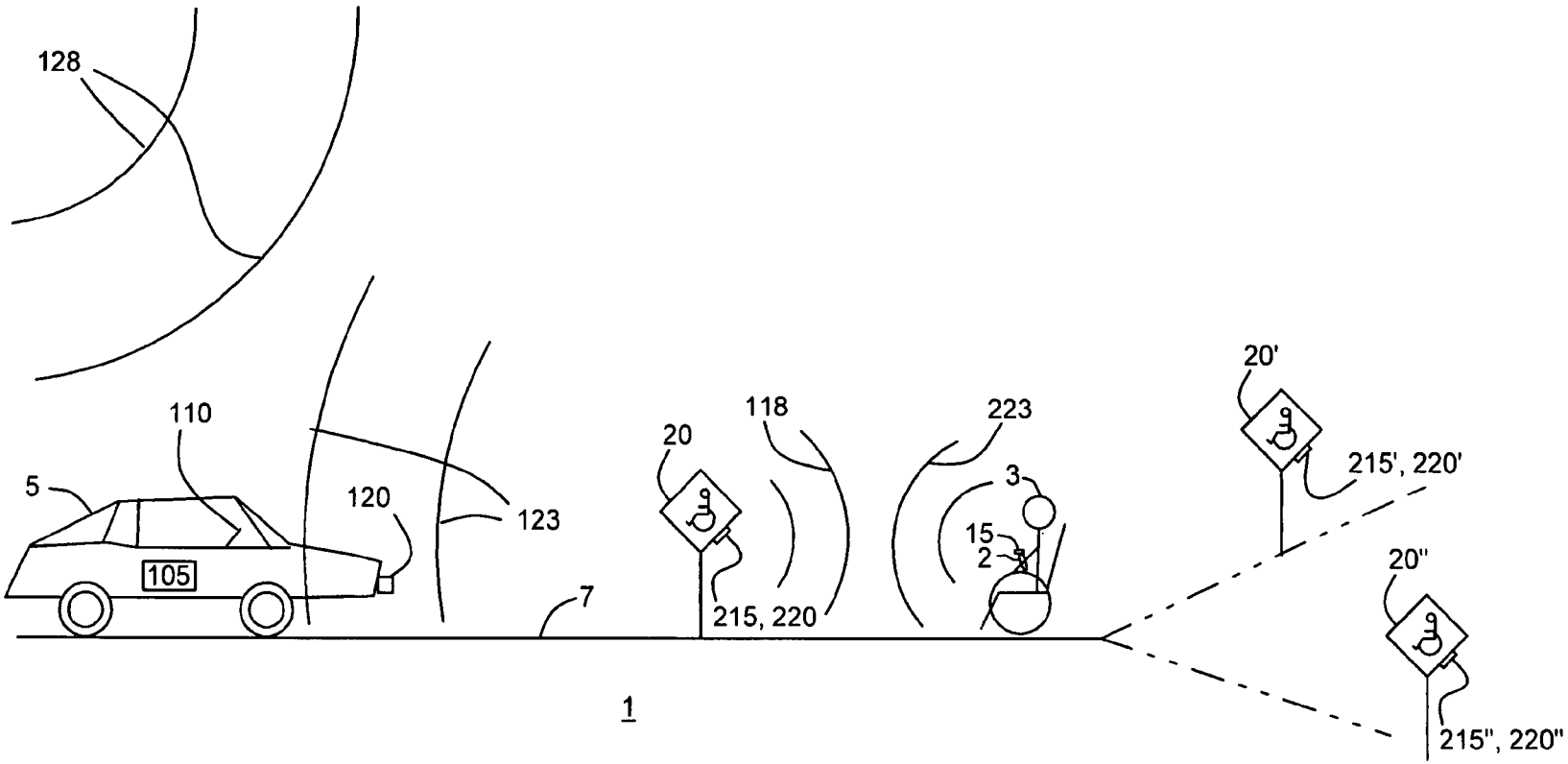
FIG. 1 is a diagram of a roadway system in accordance with an exemplary by embodiment of the present invention.

FIG. 1 shows system 1 in accordance with an exemplary embodiment of the present invention. Automobile 5 travels along roadway 7 having traffic sign 20.

Traffic sign 20 includes antenna 215 that sends an interrogation signal 118 to passive RFID tag 15 on bracelet 2 worn by person 3.

Passive RFID tag 15 has no internal power supply. An electrical current induced in its antenna by the incoming radio frequency signal 118 provides power for a CMOS integrated circuit in tag 15 to transmit a response signal 223, which is received by antenna 220 on road sign 20. Signal 223 includes a personal ID number that, in the case of sign 3, identifies person 3 as someone for which sign 20 was installed.

Tag 15 transmits the response signal 223, without attention or action required by person 3.

In response to detecting person 3, via signal 223, circuitry in sign 20 transmits a signal 123, which is received by antenna 120 on automobile 5. Signal 123 includes a road sign ID number that, in the case of sign 20, identifies a sign depicting a person in a wheel chair.

Automobile 5 also includes a global positioning system (GPS) receiver 127 (FIG. 2) that receives signal 128 transmitted from a satellite, to allow circuitry in automobile 5 to determine the latitude and longitude of automobile 5. In this Patent Application, the word circuitry encompasses dedicated hardware, and/or programmable hardware, such as a central processing unit (CPU) or reconfigurable logic array, in combination with programming data, such as sequentially fetched CPU instructions or programming data for a reconfigurable array. Thus, circuitry encompasses, for example, a general-purpose electronic processor programmed with software, acting to carry out a described function.

Figure 2:
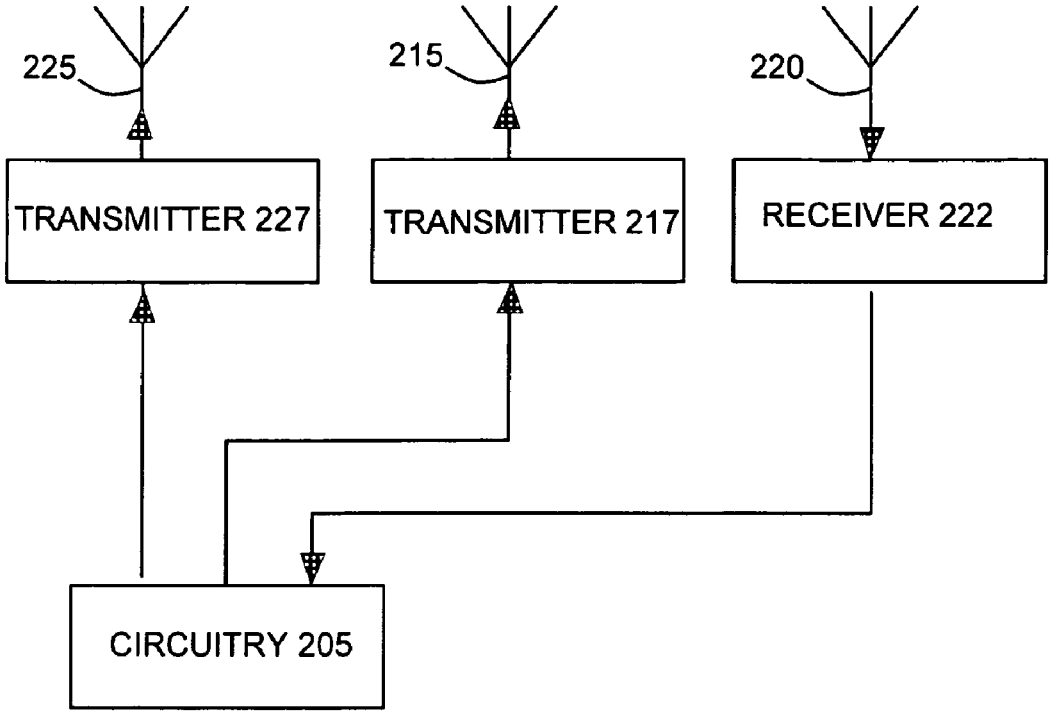
FIG. 2 is a block diagram emphasizing circuitry associated with a road sign shown in FIG. 1.

FIG. 2 shows certain aspects of circuitry in sign 20. Circuitry 205 receives signals from receiver 222.

Figure 3:
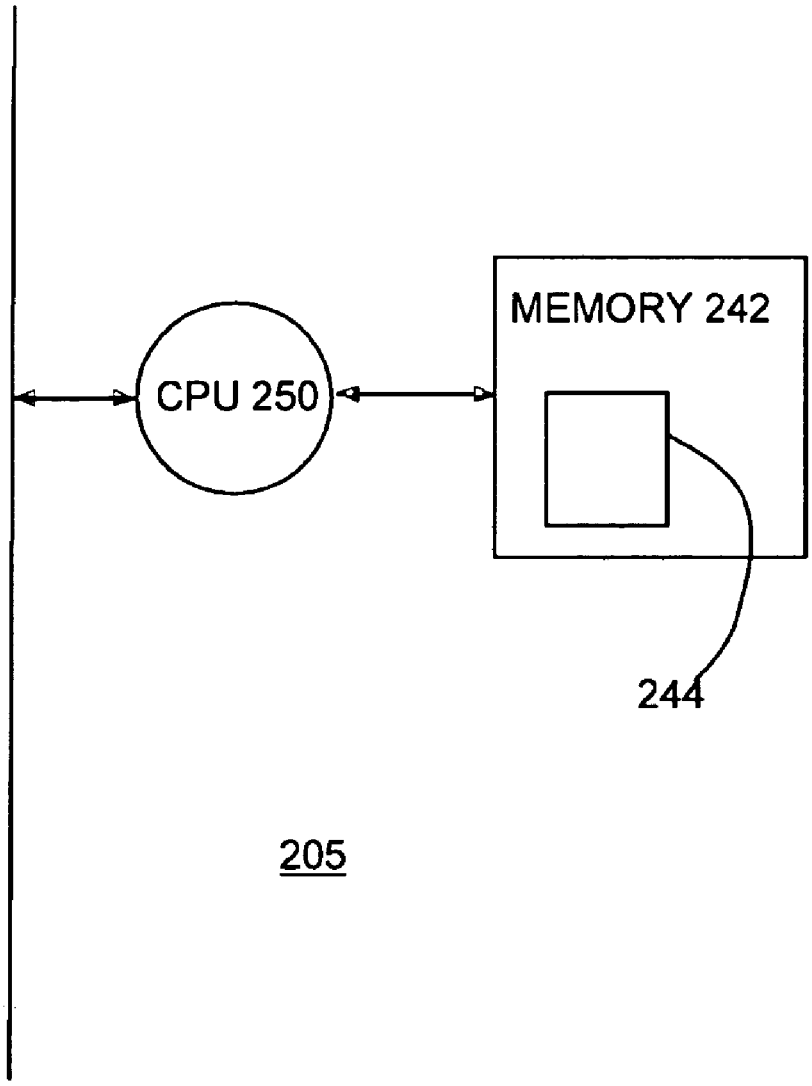
FIG. 3 is a block diagram emphasizing aspects of the circuitry shown in FIG. 2.

FIG. 3 is a block diagram of circuitry 205. Central processing unit (CPU) 250 executes program 244, in random access memory 242.

Figure 4:
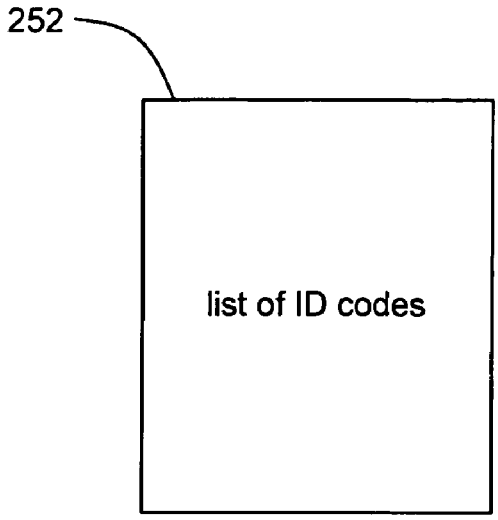
FIG. 4 is a diagram showing a data structure associated with the road sign shown in FIG. 1.

FIG. 4 shows data structure 252 in memory 242. Structure 252 includes a list of one or more identification codes, including the code transmitted by bracelet 2. Circuitry in other road signs, such as road signs 20' and road signs 20" at different roadway locations, may also store the code transmitted by bracelet 2.

Figure 5:
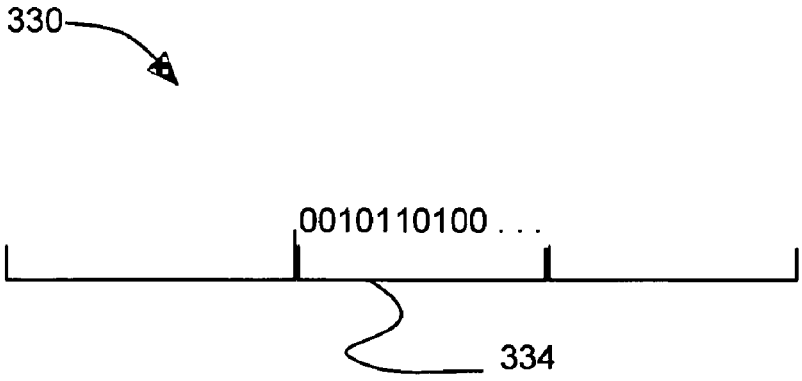
FIG. 5 is a diagram showing a signal transmitted in the exemplary system.

FIG. 5 shows a packet 330 generated by RFID tag 15 on bracelet 2, in response to receiving the interrogation signal 118. Packet 330 includes bits 334 encoding an identification code associating person 3 to sign 20.

Figure 6:
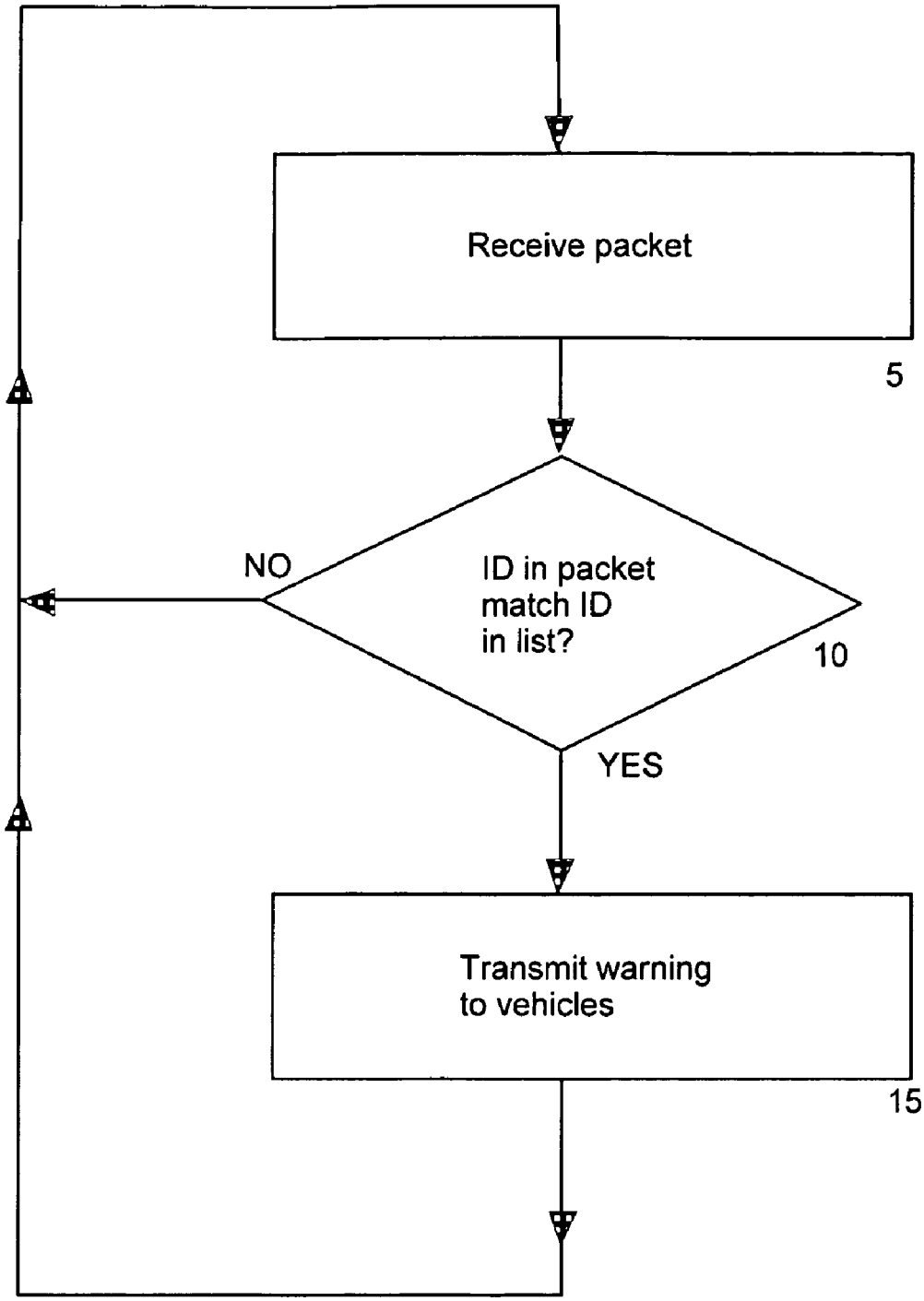
FIG. 6 is a flowchart of processing performed by circuitry associated with sign 20.

FIG. 6 shows a processing performed by circuitry 205 associated with sign 20. Circuitry 205 causes transmitter 217 to transmit an interrogation signal via antenna 215. Receiver 222 receives a radio signal and demodulates the signal into a packet containing an identification code having digits (step 5). Circuitry 205 executes software to determine whether the identification code corresponding to a code on the list of data structure 252 (step 10). If the packet does contain a code corresponding to a code on the list, circuitry 205 causes the transmitter 227 to transmit a radio warning signal to vehicles in the area, including car 5 (step 15).

Figure 7:
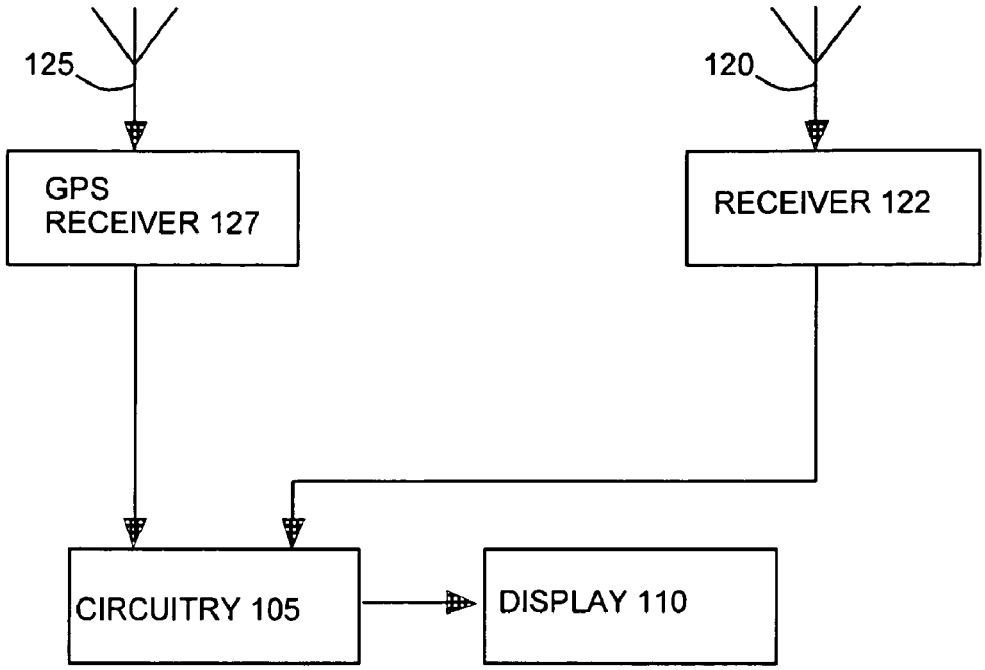
FIG. 7 is a block diagram emphasizing certain aspects of the system shown in FIG. 1.

FIG. 7 shows a block diagram emphasizing certain aspects of circuitry in automobile 5. Circuitry 105 receives signals from receiver 122 and receiver 127, and sends signals to display 110.

Figure 8:
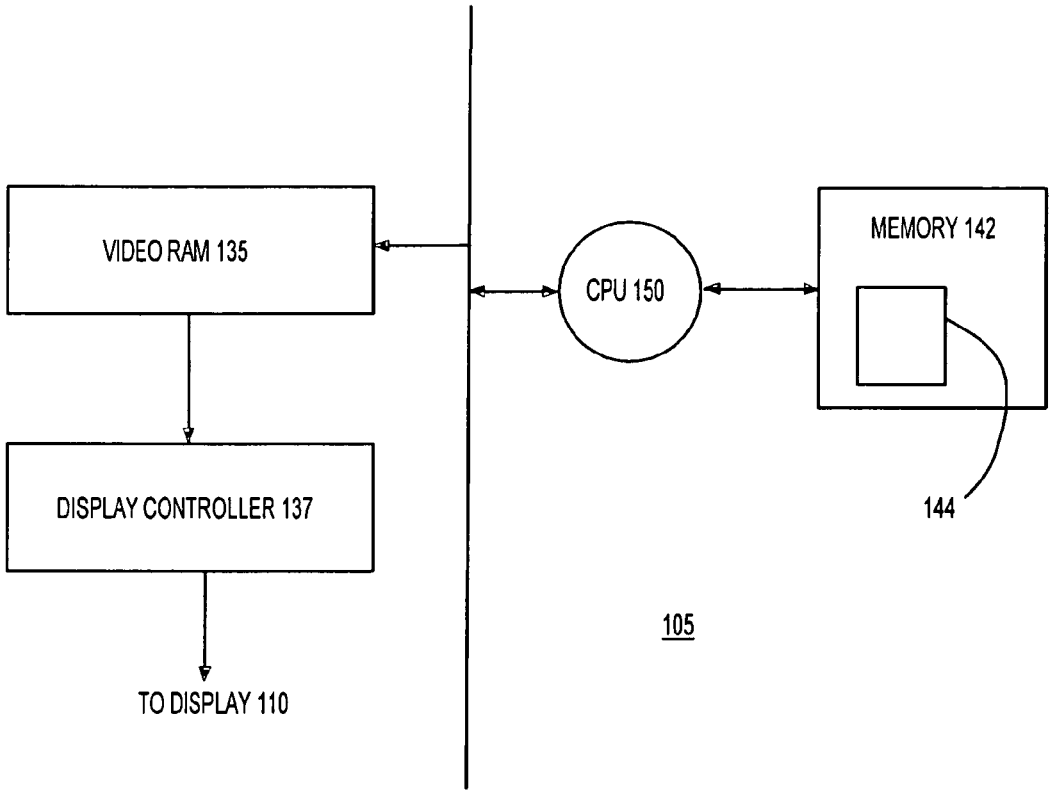
FIG. 8 is a block diagram emphasizing other aspects of the system shown in FIG. 1.

FIG. 8 is a block diagram of circuitry 105. Display 110 is 1024 pixel rows by 1280 pixel columns. Video ram 135 has 1024×1280 locations, a location for each pixel on display 110. Display controller 137 has circuitry to read video ram 135 to generate and send signals to display 110.

Central processing unit (CPU) 150 executes program 144, in random access memory 142, to display information reflecting the proximity of sign 20 relative to automobile 5, and the terrain surrounding automobile 5. CPU 150 displays the information on display 110, by writing pixel data into video RAM 135. Display controller 137 reads the pixel data from RAM 135 to send video signals to display 110.

Figure 9:
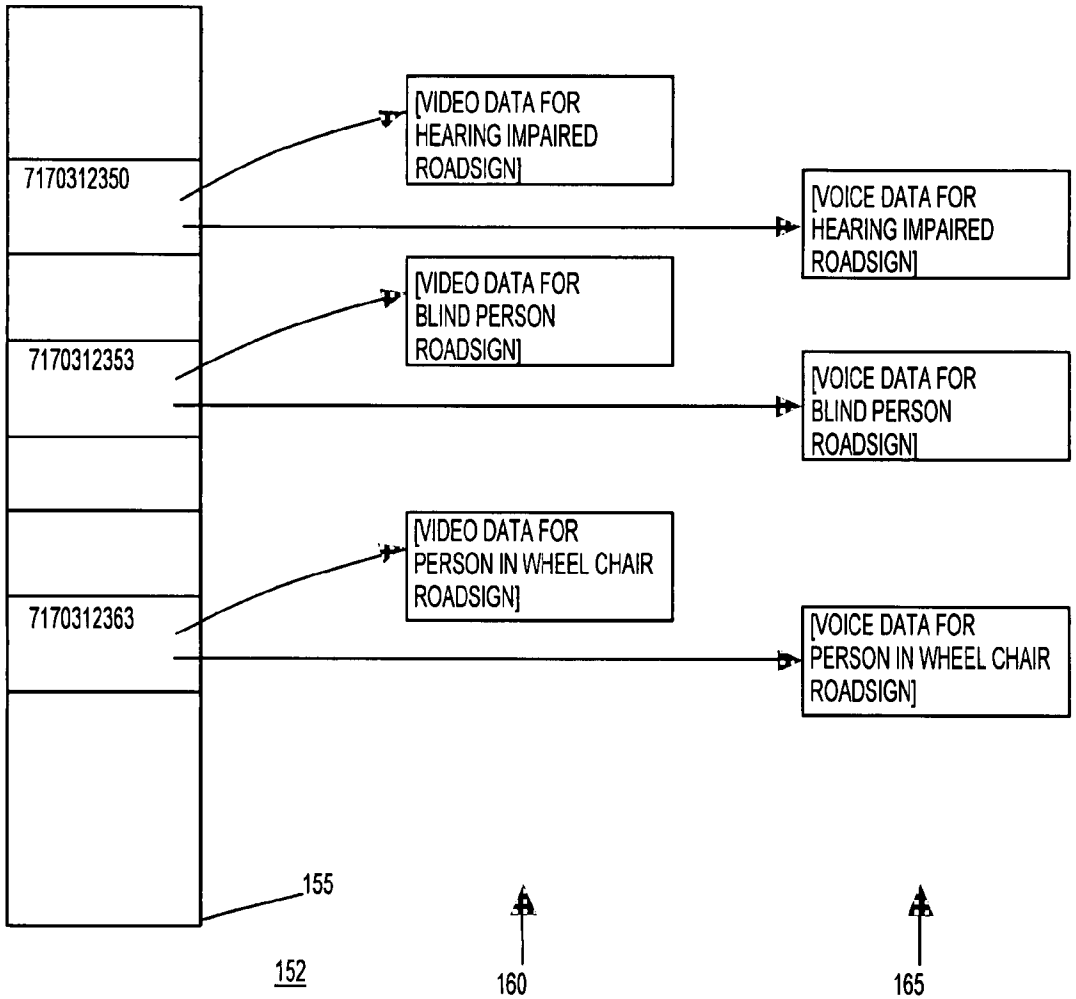
FIG. 9 is a diagram emphasizing other aspects of the system shown in FIG. 1.

FIG. 9 shows data structure 152 in memory 142. Structure 152 includes pixel data for displaying an image of a road sign corresponding to the image of the road associated with the circuitry described above. Structure 152 includes table 155, which is a list of entries keyed by a road sign ID code. Each entry in table 155 includes a road sign ID code, a pointer to pixel data 160 for the road sign identified by the road sign ID code, and a pointer to audio data 165 for the road sign identified by the road sign ID code. Pixel data 160 is a group of records each containing pixel data depicting a respective road sign. Audio data 165 is a group of records each containing digitized voice data to issue an alert or warning corresponding to a respective road sign. CPU 150 uses the pointers to access a selected record of pixel data 160 and/or audio data 165.

Figure 10:
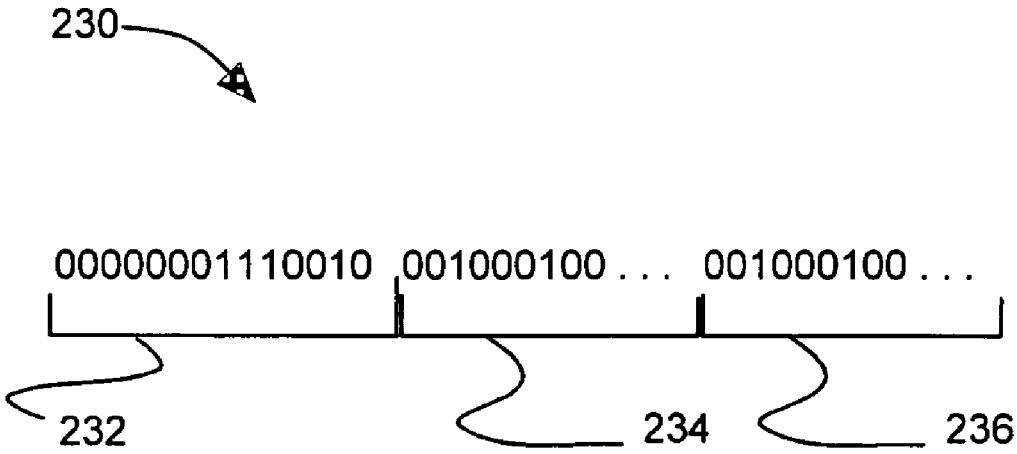
FIG. 10 is a diagram showing a signal transmitted in the exemplary system.

FIG. 10 shows a packet 230 generated by circuitry 205 in response to detecting person 3. Packet 230 includes bits 232 encoding a road sign ID code, corresponding to traffic sign 20. Packet 230 also includes bits 234 encoding the longitude and latitude of the position of traffic sign 20, and bits 236 encoding a radius. Circuitry 205 encodes packet 230 in signal 123.

Figure 11:
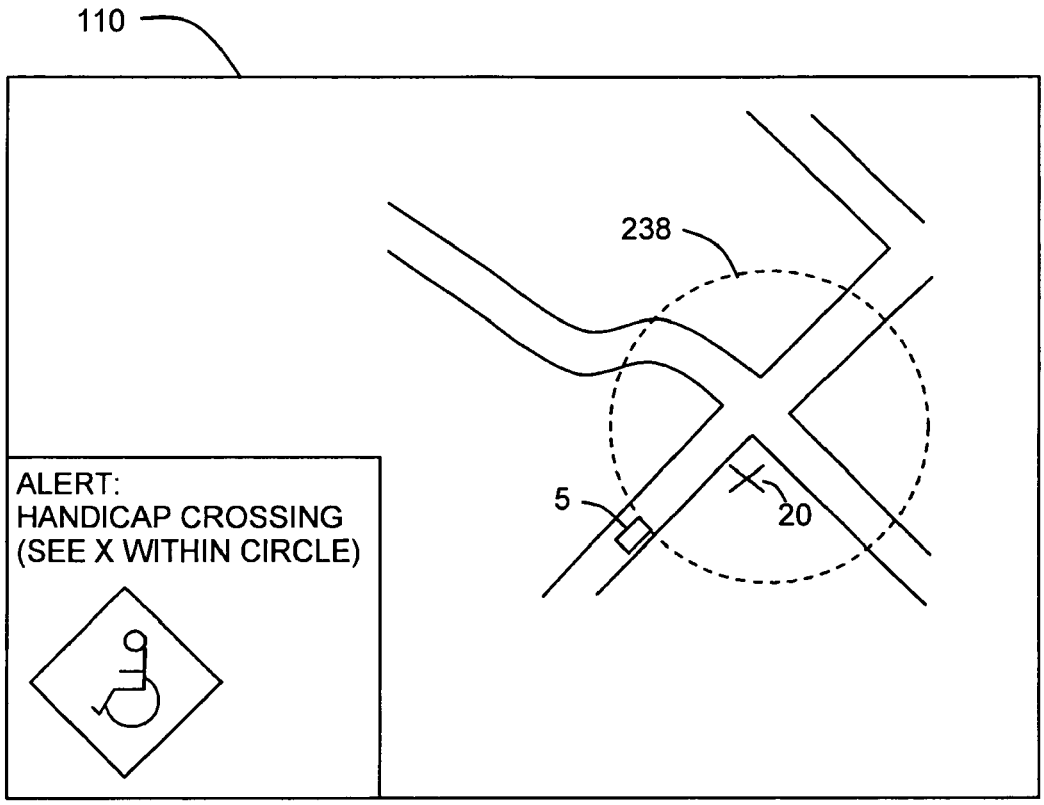
FIG. 11 is an image on an electronic display in the exemplary system.

FIG. 11 shows display 110, showing the present position 5 of automobile 5, the present position 5 being determined by GPS system 127. Display 110 also shows a circle 238 having a center 20 determined by the latitude and longitude encoded in bits 234 and a radius determined by bits 236 of the packet transmitted by circuitry 205.

Thus, the exemplary system supplements traditional road signs that warn motorists of wheel chair crossing, or deaf or blind person in the area. The system transmits a radio warning signal to vehicles, but only when the special needs person is in the area; the system does not transmit the radio warning in response to other pedestrians in the area. Thus, for example, the circuitry on the sign also has a receiver that detects a signal from an ID bracelet worn by the special needs person for whom the sign was installed. The signal from the ID bracelet encodes a serial number unique to the person.

When the sign circuitry detects the person's serial number, the sign circuitry transmits a warning signal to cars in the area, thereby causing an in-car system to alert the driver with an audio and/or visual display.

In an alternative system, instead of a unique code per person, each person's transmitter may transmit a code indicating a class of persons, such as hearing impaired, blind, or wheelchair. A central authority or registry could assign generic codes for the United States.

Another option is that the municipality who erects and programs the sign uses the persons drivers license or id number. Alternatively, a structure like the UPC council could be formed that would allocate a number per person.

Another option would be to have wireless connectivity to the internet for the sign and be able to download the entire list of people registered.

The road sign could include a changeable display, such as a liquid crystal display, and different warnings be displayed based on the bracelets in range; recognize the person and type of disability and display the appropriate sign.

When circuitry 105 in a car 5 receives a signal associated with a road sign, the motorist is also sent an alert sound that overrides vehicle audio systems to inform them of the condition, to ensure the driver uses extra caution and pays additional attention in the area. As shown in FIG. 9, the audio alert may include a voice signal. For example, if the road signal is for a hearing impaired person, circuitry in the car may play a verbalized announcement "Caution, hearing impaired area".

The packet sent by sign circuitry 205 may also include contact information if an accident occurs, etc.

The alert device continues to provide feedback as to the proximity of the tag until the tag is out of range.

The method allows the user to override (silence for a predetermine length of time) situations where multiple alerts are received or when there is a delay in passing out of the range of the road sign. For example, the user may activate an override when waiting behind a stopped school bus.

The alert may be overridden if the vehicle is at a full and complete stop.

Thus, the packet transmitted by sign circuitry 205 identifies the Special Need, and may provide a contact name if the sign was erected for a specific person, and additional information that may assist the motorist to monitor and to handle any issues.

The packet transmitted by sign circuitry 205 may include personalized information: female teenager, brown hair, speed limit: 10.

Throughout this Patent Application, certain processing may be depicted in serial, parallel, or other fashion, for ease of description. Actual hardware and software realizations, however, may be varied depending on desired optimizations apparent to one of ordinary skill in the art.

Additional advantages and modifications will readily occur to those skilled in the art. The invention in its broader aspects is therefore not limited to the specific details, representative apparatus, and illustrative examples shown and described. Accordingly, departures may be made from such details without departing from the spirit or the scope of Applicants' general inventive concept. The invention is defined in the following claims. In general, the words "first," "second," etc., employed in the claims do not necessarily denote an order.

What is claimed is:

1. A method for warning a vehicle approaching a changeable road sign, the method comprising:

receiving an identification signal from a device carried by a human having a medical condition, at a time when the human is in the vicinity of the changeable road sign;

demodulating the identification signal into a digital signal;

comparing the digital signal to a data structure associated with the changeable road sign, the data structure indicating a plurality of medical conditions;

determining if the digital signal indicates a medical condition indicated by the data structure;

depending on a result of the determining step, conditionally causing the changeable road sign to display the medical condition indicated by the digital signal; and depending on the result of the determining step, conditionally transmitting a radio warning signal to the vehicle, the radio warning signal indicating the medical condition indicated by the digital signal.

* * * * *